US011896098B2

(12) United States Patent
Zhang et al.

(10) Patent No.: US 11,896,098 B2
(45) Date of Patent: Feb. 13, 2024

(54) TRACEABLE CARD HOLDER

(71) Applicants: Xiangyang Zhang, Guangdong (CN); Yi Xiao, Guangdong (CN)

(72) Inventors: Xiangyang Zhang, Guangdong (CN); Yi Xiao, Guangdong (CN)

(73) Assignee: Shenzheen YaJing Industrial Co., Ltd., Shenzhen (CN)

( * ) Notice: Subject to any disclaimer, the term of this patent is extended or adjusted under 35 U.S.C. 154(b) by 168 days.

(21) Appl. No.: 17/512,697

(22) Filed: Oct. 28, 2021

(65) Prior Publication Data

US 2023/0136219 A1 May 4, 2023

(51) Int. Cl.

| | |
|---|---|
| ***A45C 1/06*** | (2006.01) |
| ***A45C 11/18*** | (2006.01) |
| ***A45C 13/18*** | (2006.01) |

(52) U.S. Cl.

CPC ..... *A45C 1/06* (2013.01); *A45C 11/182* (2013.01); *A45C 13/185* (2013.01); *A45C 2001/065* (2013.01); *A45C 2001/067* (2013.01)

(58) Field of Classification Search

CPC ..... A45C 1/06; A45C 11/182; A45C 13/185; A45C 2001/065; A45C 2001/067

USPC ..... 150/131

See application file for complete search history.

(56) References Cited

U.S. PATENT DOCUMENTS

| | | | | |
|---|---|---|---|---|
| 2002/0056652 | A1* | 5/2002 | Kawamura | A45C 11/182 206/37 |
| 2021/0007450 | A1* | 1/2021 | Kane | A45C 13/185 |

* cited by examiner

*Primary Examiner* — John K Fristoe, Jr.
*Assistant Examiner* — Jessica Kavini Tamil

(57) ABSTRACT

The invention discloses a traceable card holder, comprising a first clamp plate, a second clamp plate, an elastic band, top cover components, bottom cover components, a tracker and an elastic clamp; the first clamp plate is arranged oppositely to the second clamp plate, the elastic band is connected respectively with the first clamp plate and the second clamp plate, and the elastic band is used to drive the first clamp plate and the second clamp plate to move towards each other for clamping; the top cover components are detachably mounted on one side of the first clamp plate which is away from the second clamp plate, and the tracker is detachably mounted on the top cover components.

7 Claims, 4 Drawing Sheets

TRACEABLE CARD HOLDER

BACKGROUND OF THE INVENTION

1. Field of the Invention

The invention relates to a technical field of the card holder, in particular to a traceable card holder.

2. Description of the Related Art

The card holder is a kind of small bag used for storing bank cards, ID cards, membership cards and other cards, and the traditional card holder function is single, only with the storage function, without the traceability function. Once the card holder is lost, it is not easy to retrieve, which will bring huge losses to the owner, so it is necessary to optimize and improve the card holder.

SUMMARY OF THE INVENTION

The invention is aimed to at least solve one of the existing technical problems in the current technology. Therefore, one purpose of the invention is to provide a traceable card holder.

The technical schemes of the invention are as follows: a traceable card holder, comprising a first clamp plate, a second clamp plate, an elastic band, top cover components, bottom cover components, a tracker and an elastic clamp;

the first clamp plate is arranged oppositely to the second clamp plate, the elastic band is connected respectively with the first clamp plate and the second clamp plate, and the elastic band is used to drive the first clamp plate and the second clamp plate to move towards each other for clamping;

the top cover components are detachably mounted on one side of the first clamp plate which is away from the second clamp plate, and the tracker is detachably mounted on the top cover components, the bottom cover components are detachably mounted on one side of the second clamp plate which is away from the first clamp plate, and the elastic clamp is mounted on the bottom cover components.

Preferably, the top cover components comprise a first lining plate and a top cover, and the first lining plate is connected with the first clamp plate, the top cover is connected with the first lining plate, and the tracker is connected with the top cover by snaps.

Preferably, the first clamp plate is provided with first screw holes, and the first lining plate is provided with first escape holes, the top cover is provided with second escape holes, and the first screws are connected with the threads of the first screw holes through the second escape holes and the first escape holes.

The top cover is provided with mounting holes, and the top cover is provided with a slidable fixture block, the inner wall surface of the mounting holes is provided with stop protrusions, and the stop protrusions are opposite to the fixture block, along the sliding direction of the fixture block;

the outer circumferential surface of the tracker is provided with circular card slots extending along the circumference of the tracker, the tracker is embedded in the mounting holes, and one part of the stop protrusions and one part of the fixture block are both inserted in the card slots.

Preferably, the surface of the top cover which is close to the first lining plate is provided with first sliding slots, and the first sliding slots are communicated with the mounting holes, the surface of the first sliding slots which is away from the first lining plate is provided with second sliding slots, and the second sliding slots penetrate the top cover; the fixture block comprises a substrate, a pushing block and a latching strip, and the substrate is slidably provided in the first sliding slots, one side of the substrate which is close to the mounting holes is provided with the latching strip, and the latching strip is inserted in the card slots, one side of the substrate which is away from the mounting holes is provided with the springs, and the springs abut against the top cover, the surface of the substrate which is away from the first lining plate is provided with the pushing block, and the pushing block is provided in the second sliding slots.

Preferably, one side of the substrate which is away from the mounting holes is provided with positioning holes, and one part of the springs is provided in the positioning holes.

Preferably, the surface of the first clamp plate which is away from the second clamp plate is provided with first receiving slots and second receiving slots, and the second receiving slots are communicated with the first receiving slots, the surface of the second clamp plate which is away from the first clamp plate is provided with third receiving slots and fourth receiving slots, and the fourth receiving slots are communicated with the third receiving slots, the first receiving slots are opposite to the third receiving slots, and the second receiving slots are opposite to the fourth receiving slots;

the elastic band comprises a circular main body portion and a strip-shaped connection portion, and two ends of the connection portion are respectively connected with the main body portion, the main body portion is externally sleeved on the first clamp plate and the second clamp plate, and one part of the main body portion is provided in the first receiving slots, one part is provided in the third receiving slots, and one part of the connection portion is provided in the second receiving slots, one part is provided in the fourth receiving slots.

Preferably, the bottom cover components comprise a second lining plate and a bottom cover, and the second lining plate is connected with the second clamp plate, the elastic clamp is connected with the second lining plate, and the bottom cover is connected with the second lining plate.

Preferably, the second clamp plate is provided with second screw holes, and the second lining plate is provided with third escape holes, the bottom cover is provided with fourth escape holes, and the second screws are connected with the threads of the second screw holes through the third escape holes and the fourth escape holes.

Compared to the current technology, the beneficial effects of the invention are as follows:

the invention integrates a tracker on the card holder, so when the card holder is lost, it can be retrieved by the tracker, which avoids to cause losses, and the tracker and the top cover components are detachably connected with each other, so that the tracker and the card holder can be used independently or together.

The additional aspects and advantages of the invention will be partly described below, and the part of them will be more obvious in the following description or will be known by the embodiments of the invention.

BRIEF DESCRIPTION OF THE DRAWINGS

To describe the technical schemes in embodiments of the invention or the current technology more clearly, a brief introduction will be given below on the attached drawings used as needed in the embodiments or the current technology, and obviously, the attached drawings in the following description are only some of the embodiments in the invention, and for the common technicians in the field, in the premise of not doing the creative work, other attached drawings can be obtained according to these attached drawings.

Figure 1:
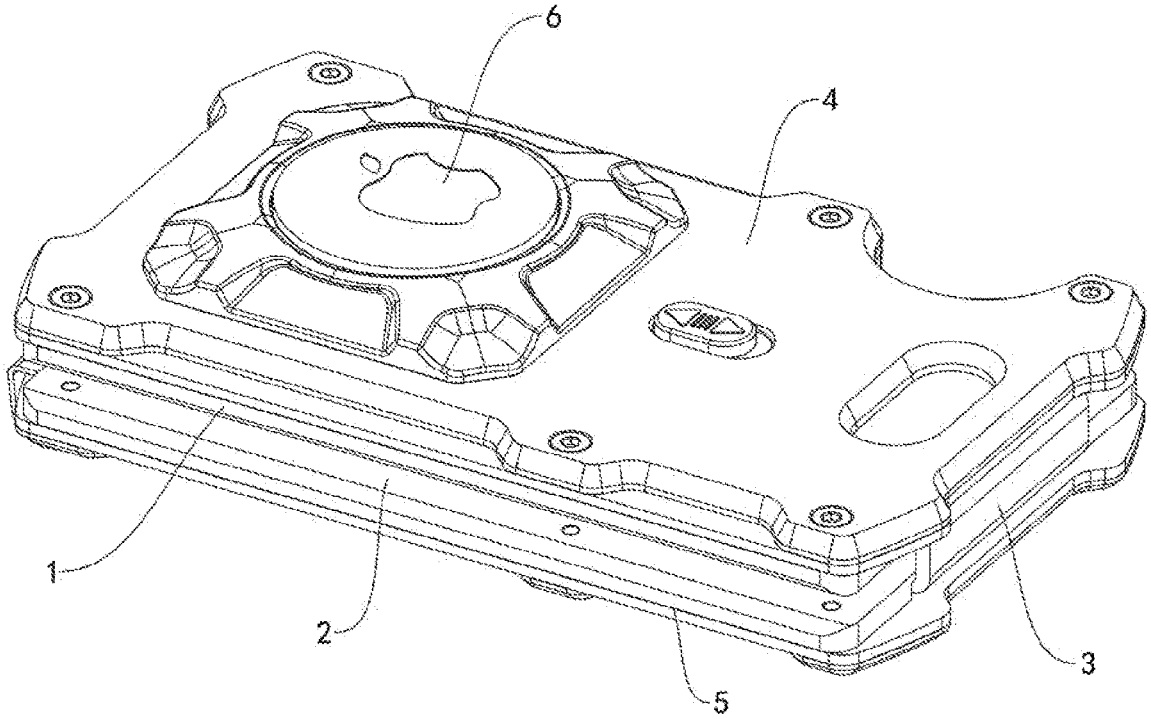
FIG. 1 is a perspective view of the invention.

The marks of the attached drawings are as follows:

1. the first clamp plate; 2. the second clamp plate; 3. the elastic band; 4. the top cover components; 5. the bottom cover components; 6. the tracker; 7. the elastic clamp; 8. the first lining plate; 9. the top cover; 10. the first screws; 11. the mounting holes; 12. the fixture block; 13. the stop protrusions; 14. the card slots; 15. the first sliding slots; 16. the second sliding slots; 17. the substrate; 18. the pushing block; 19. the latching strip; 20. the springs; 21. the first receiving slots; 22. the second receiving slots; 23. the main body portion; 24. the connection portion; 25. the second lining plate; 26. the bottom cover; 27. the second screws.

DESCRIPTION OF EMBODIMENTS

To make the purposes, technical schemes and advantages in the embodiments of the invention clearer, in combination with the attached drawings in the embodiment of the invention, a clear and complete description about technical schemes of the embodiment in the invention will be given below, and obviously, described embodiments are a part of those in the invention, other than all embodiments. Based on embodiments of the invention, all other embodiments acquired by common technicians in the field in the premise of not doing the creative work are within the protection scope of the invention.

The detailed description of the embodiments in the invention is given below and examples of the embodiments are shown in the attached drawings, wherein the same or similar reference numbers throughout represent the same or similar elements or elements of the same or similar functions. In the description of the invention, it should be understood that the orientation or positional relationship indicated by the terms "upper", "lower", "front", "back", "left", "right", "inner", "outer", "vertical", "circumferential", "radial", "axial" etc. is based on the orientation or positional relationship shown in the drawings, and is only for the convenience of describing the invention and simplifying the description, but not indicate or imply that the pointed device or element must have a specific orientation, be constructed and operated in a specific orientation, and therefore cannot be understood as a limitation of the invention.

In the description of the invention, "the first feature" and "the second feature" can include one or more of these features. In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features.

In the invention, unless otherwise clearly defined and limited, the terms "provided", "sleeved", "connected", "fixed" and other terms should be interpreted broadly, for example, it can be a fixed connection, it can be a detachable connection or integrated; it can be a mechanical connection, or an electrical connection; it can be a direct connection, or an indirectly connection through an intermediate medium, and it can be an internal communication between two elements or the interaction relationship between two elements. For common technicians in the field, the specific meaning of the above terms in the invention can be understood according to specific circumstances.

With reference to the attached drawings of FIG. 1 to FIG. 6, a traceable card holder according to the embodiments of the invention is described below, comprising a first clamp plate 1, a second clamp plate 2, an elastic band 3, top cover components 4, bottom cover components 5, a tracker 6 and an elastic clamp 7.

Figure 2:
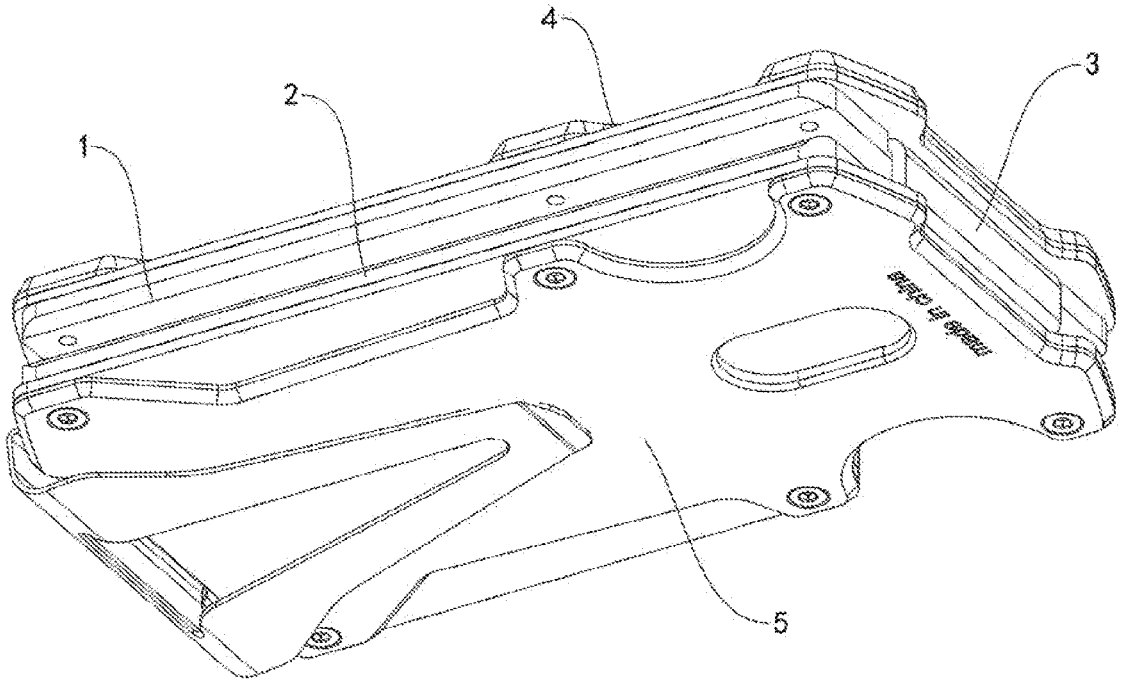
FIG. 2 is a perspective view of the invention.

As FIG. 1 and FIG. 2 show, the first clamp plate 1 is arranged oppositely to the second clamp plate 2, the elastic band 3 is connected respectively with the first clamp plate 1 and the second clamp plate 2, and the elastic band 3 is used to drive the first clamp plate 1 and the second clamp plate 2 to move towards each other for clamping; the top cover components 4 are detachably mounted on one side of the first clamp plate 1 which is away from the second clamp plate 2 (for example, the upper side shown in the figure), and the tracker 6 is detachably mounted on the top cover components 4, the bottom cover components 5 are detachably mounted on one side of the second clamp plate 2 which is away from the first clamp plate 1 (for example, the lower side shown in the figure), and the elastic clamp 7 is mounted on the bottom cover components 5.

More precisely, the first clamp plate 1 is arranged oppositely to the second clamp plate 2 so as to define the space for storing cards, and after the cards are placed between the first clamp plate 1 and the second clamp plate 2, under the function of the elastic band 3, the first clamp plate 1 and the second clamp plate 2 will clamp and fix the cards; the first clamp plate 1 is provided with the top cover components 4, and the top cover components 4 is provided with the tracker 6, so when the card holder is lost, it can be retrieved by the tracker 6, which avoids to cause losses, and the tracker 6 and the top cover components 4 are detachably connected with each other, so that the tracker 6 and the card holder can be used independently or together; the second clamp plate 2 is provided with the bottom cover components 5, and the bottom cover components 5 is provided with the elastic clamp 7, so the elastic clamp 7 can be clamped in the pocket and other positions to achieve the fixing of the card holder, easy to use.

What needs to be explained is that there is no limitation to the specific types of the tracker 6 in the application and it can be selected and set according to the actual requirements. In the description of the application, AirTag of Apple Inc. is selected as the tracker 6 as an example to make description, and AirTag can be attached on the handbags, keys, backpacks or other things. When the settings are finished, users can view the current or last known location of an item on a map in the new "Items" tab in the "Find" app. If the item is within the bluetooth range, the "Find" app. can make AirTag play sounds. If AirTag is separated from the owner and not within the bluetooth range, the "Find" network can also help to track it. A detailed description of specific structures of each part of the card holder is given below.

Figure 3:
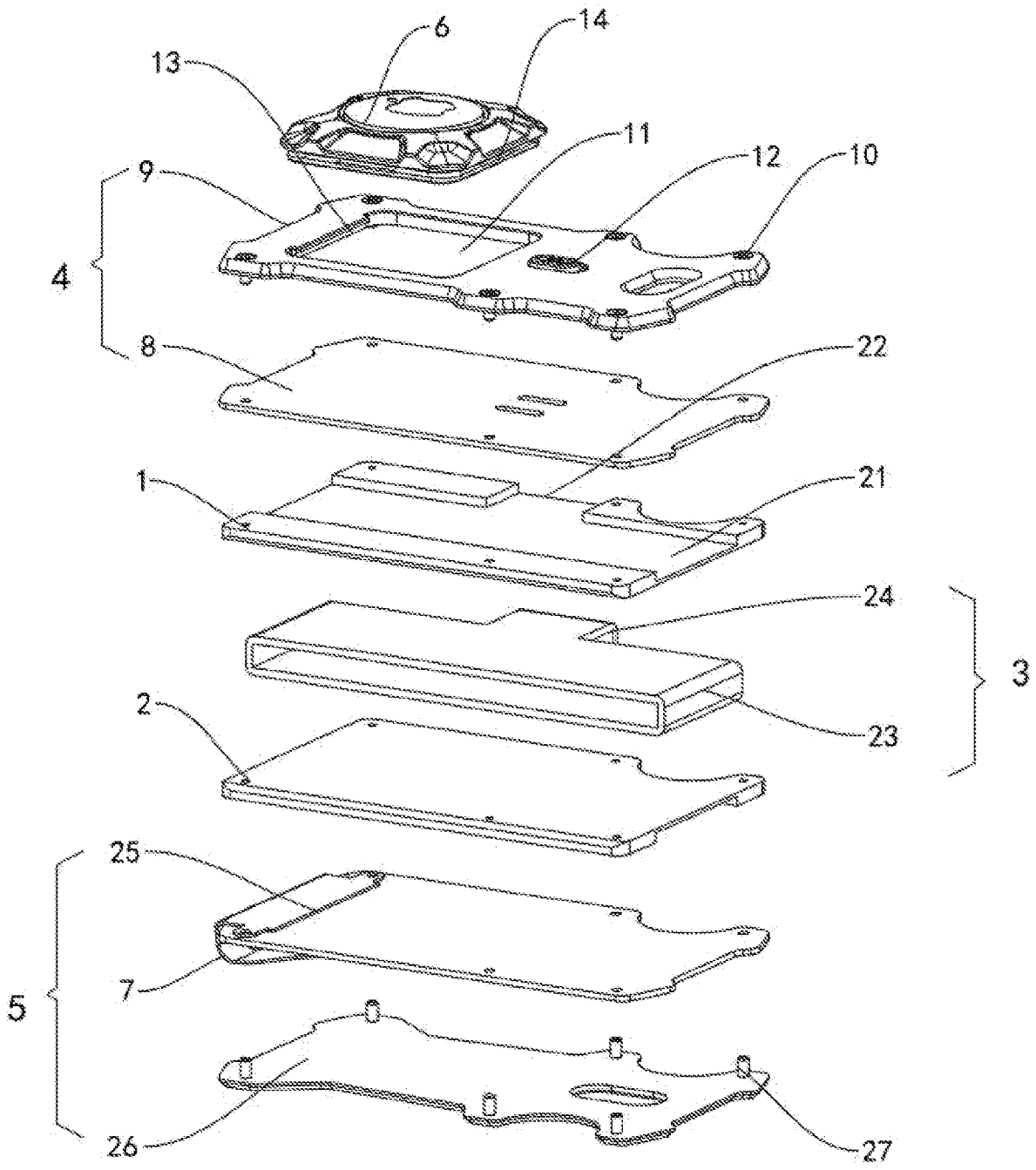
FIG. 3 is an exploded view of the invention.
Figure 4:
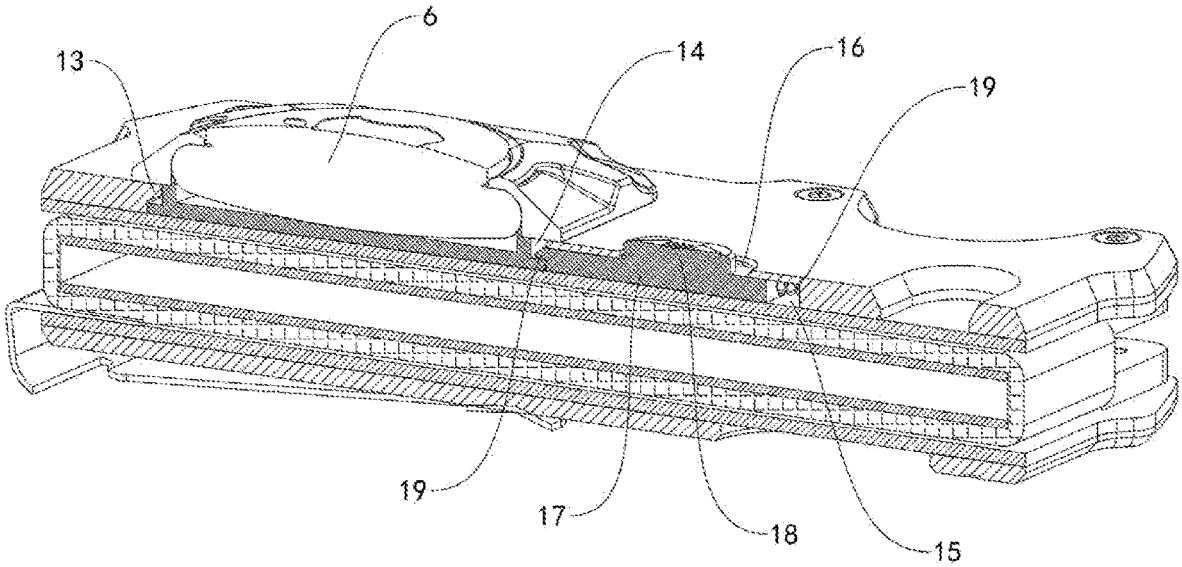
FIG. 4 is a sectional view of the invention.

In the embodiment, as FIG. 3 and FIG. 4 show, the surface of the first clamp plate 1 which is away from the second clamp plate 2 (for example, the upper surface of the first clamp plate 1 in the figure) is provided with first receiving slots 21 and second receiving slots 22, and the second receiving slots 22 are communicated with the first receiving slots 21, the surface of the second clamp plate 2 which is away from the first clamp plate 1 (for example, the lower surface of the second clamp plate 2 in the figure) is provided with third receiving slots and fourth receiving slots, and the fourth receiving slots are communicated with the third receiving slots, the first receiving slots 21 are opposite to the third receiving slots, and the second receiving slots 22 are opposite to the fourth receiving slots; the elastic band 3 comprises a circular main body portion 23 and a strip-shaped connection portion 24, and two ends of the connection portion 24 are respectively connected with the main body portion 23, the main body portion 23 is externally sleeved on the first clamp plate 1 and the second clamp plate 2, and one part of the main body portion 23 is provided in the first receiving slots 21, one part is provided in the third receiving slots, and one part of the connection portion 24 is provided in the second receiving slots 22, one part is provided in the fourth receiving slots.

Therefore it is convenient to sleeve the elastic band 3 on the first clamp plate 1 and the second clamp plate 2, and designs of each receiving slot can space different parts of the elastic band 3 to avoid the deviation of the elastic band 3, and the connection portion 24 in the elastic band 3 can not only connect the main body portion 23 but also prevent the cards from falling from the back side when the cards are placed from the front side between the first clamp plate 1 and the second clamp plate 2.

In the embodiment, as FIG. 3 and FIG. 4 show, the top cover components 4 comprise a first lining plate 8 and a top cover 9, the first lining plate 8 is connected with the first clamp plate 1, and the top cover 9 is connected with the first lining plate 8. The provided first lining plate 8 plays a protective role in the first clamp plate 1, and the provided top cover 9 can play a decorative role, the tracker 6 is connected with the top cover 9 by snaps, and the connection mode of the snaps is simple, easy to detach and mount.

In the embodiment, the first clamp plate 1 is provided with first screw holes, and the first lining plate 8 is provided with first escape holes, the top cover 9 is provided with second escape holes, and the first screws 10 are connected with the threads of the first screw holes through the second escape holes and the first escape holes, so the top cover components 4 and the first clamp plate 1 can be detachably connected with each other, and the connection mode of the screws is simple, fixed and firm, not easy to loosen.

In the embodiment, as FIG. 3, FIG. 4, FIG. 5 and FIG. 6 show, the top cover 9 is provided with mounting holes 11, and the top cover 9 is provided with a slidable fixture block 12, the inner wall surface of the mounting holes 11 is provided with stop protrusions 13, and the stop protrusions 13 are opposite to the fixture block 12, along the sliding direction of the fixture block 12; the outer circumferential surface of the tracker 6 is provided with circular card slots 14 extending along the circumference of the tracker 6, the tracker 6 is embedded in the mounting holes 11, and one part of the stop protrusions 13 and one part of the fixture block 12 are both inserted in the card slots 14. Therefore when the stop protrusions 13 and the fixture block 12 both cooperate with the card slots 14, the tracker 6 can be fixed, and when sliding the fixture block 12 so that the fixture block 12 does not cooperate with the card slots 14, the tracker 6 can be taken out, which is quite easy to use.

Figure 5:
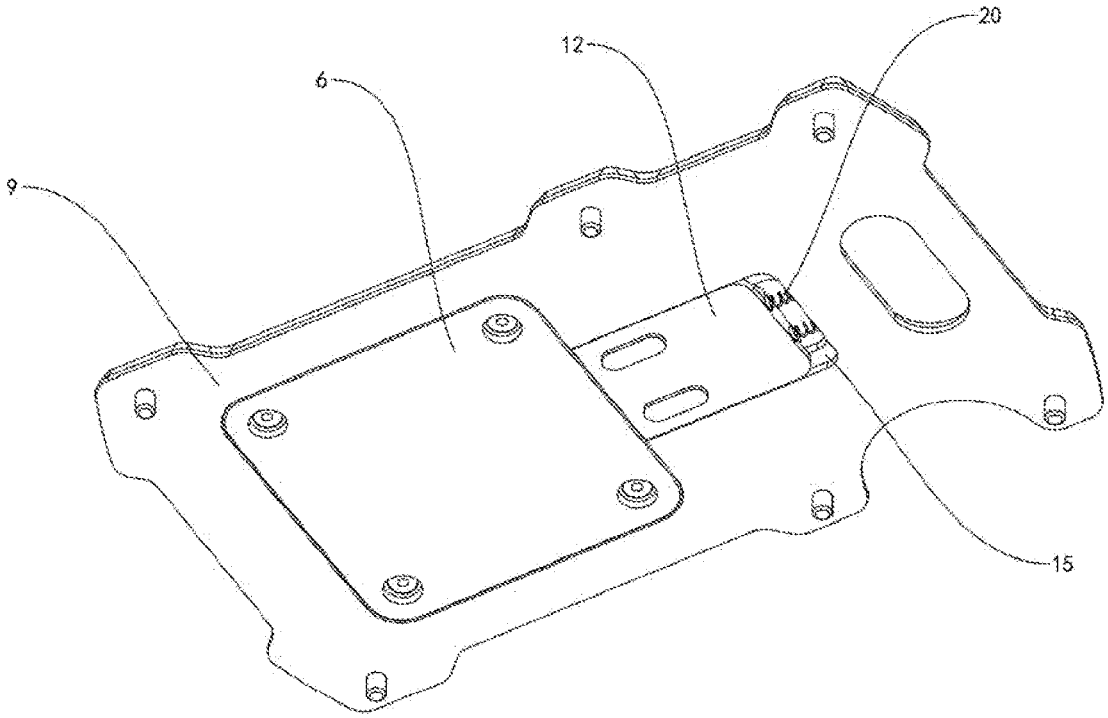
FIG. 5 is a perspective view of the top cover components in the invention.
Figure 6:
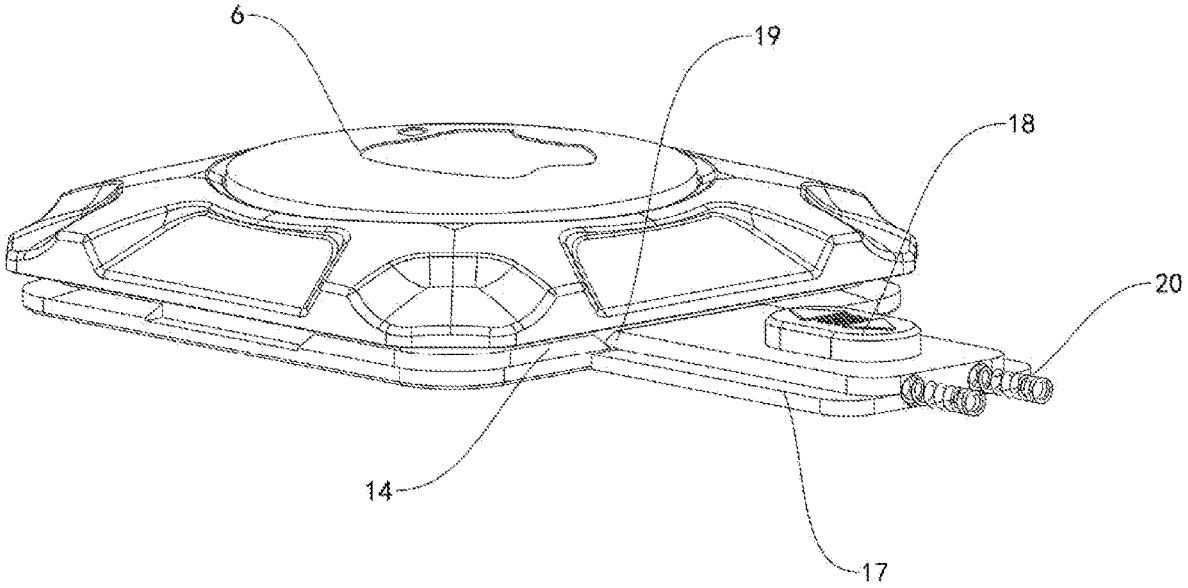
FIG. 6 is a perspective view of the tracker part in the invention.

More precisely, with reference to FIG. 5 and FIG. 6, the surface of the top cover 9 which is close to the first lining plate 8 (for example, the lower surface of the top cover 9 in the figure) is provided with first sliding slots 15, and the first sliding slots 15 are communicated with the mounting holes 11, the surface of the first sliding slots 15 which is away from the first lining plate 8 is provided with second sliding slots 16, and the second sliding slots 16 penetrate the top cover 9; the fixture block 12 comprises a substrate 17, a pushing block 18 and a latching strip 19, and the substrate 17 is slidably provided in the first sliding slots 15, one side of the substrate 17 which is close to the mounting holes 11 is provided with the latching strip 19, and the latching strip 19 is inserted in the card slots 14, one side of the substrate 17 which is away from the mounting holes 11 is provided with the springs 20, and the springs 20 abut against the top cover 9, the surface of the substrate 17 which is away from the first lining plate 8 is provided with the pushing block 18, and the pushing block 18 is provided in the second sliding slots 16.

Therefore when in use, the springs 20 are used to push the fixture block 12 to always move towards the tracker 6, when the tracker 6 needs to be removed, the pushing block 18 is pushed to overcome the elastic force of the springs 20 to make the fixture block 12 move so that the latching strip 19 does not cooperate with the card slots 14, and when the tracker 6 needs to be fixed, the springs 20 can automatically push the fixture block 12 to move so that the latching strip 19 is inserted in the card slots 14, easy to use.

In the embodiment, one side of the substrate 17 which is away from the mounting holes 11 is provided with positioning holes, and one part of the springs 20 is provided in the positioning holes, so it is easy for the mounting and positioning of the springs 20.

In the embodiment, as FIG. 2 and FIG. 3 show, the bottom cover components 5 comprise a second lining plate 25 and a bottom cover 26, and the second lining plate 25 is connected with the second clamp plate 2, the elastic clamp 7 is connected with the second lining plate 25, and the bottom cover 26 is connected with the second lining plate 25. The provided second lining plate 25 plays a protective role in the second clamp plate 2, and the provided bottom cover 26 can play a decorative role. In the embodiment, as FIG. 3 shows, the second clamp plate 2 is provided with second screw holes, and the second lining plate 25 is provided with third escape holes, the bottom cover 26 is provided with fourth escape holes, and the second screws 27 are connected with the threads of the second screw holes through the third escape holes and the fourth escape holes, so the bottom cover components 5 and the second clamp plate 2 can be detachably connected with each other, and the connection mode of the screws is simple, fixed and firm, not easy to loosen.

In conclusion, the invention provides a traceable card holder, by integrating a tracker 6 on the card holder, so when the card holder is lost, it can be retrieved by the tracker 6, which avoids to cause losses, and the tracker 6 and the top cover components 4 are detachably connected with each other, so that the tracker 6 and the card holder can be used independently or together.

Even though the embodiments of the invention have been displayed and described, for common technicians in the field, it can be understood that without departing from the principles and purposes of the invention, multiple changes, modifications, replacements and variations can be implemented on these embodiments, and the scope of the invention is limited by the claims and their equivalents.

What is claimed is:

1. A traceable card holder, comprising a first clamp plate, a second clamp plate, an elastic band, top cover components, bottom cover components, a tracker and an elastic clamp;

the first clamp plate is arranged oppositely to the second clamp plate, the elastic band is connected respectively with the first clamp plate and the second clamp plate, and the elastic band is used to drive the first clamp plate and the second clamp plate to move towards each other for clamping;

the top cover components are detachably mounted on one side of the first clamp plate which is away from the second clamp plate, and the tracker is detachably mounted on the top cover components, the bottom cover components are detachably mounted on one side of the second clamp plate which is away from the first clamp plate, and the elastic clamp is mounted on the bottom cover components;

wherein the top cover components comprise a first lining plate and a top cover, and the first lining plate is connected with the first clamp plate, the top cover is connected with the first lining plate, and the tracker is connected with the top cover by snaps;

wherein the top cover is provided with mounting holes, and the top cover is provided with a slidable fixture block, the inner wall surface of the mounting holes is provided with stop protrusions, and the stop protrusions are opposite to the fixture block, along the sliding direction of the fixture block;

the outer circumferential surface of the tracker is provided with circular card slots extending along the circumference of the tracker, the tracker is embedded in the mounting holes, and the fixture block and protrusions are within the tracker.

2. The traceable card holder according to claim 1, wherein the first clamp plate is provided with first screw holes, and the first lining plate is provided with first escape holes, the top cover is provided with second escape holes, and the first screws are connected with the threads of the first screw holes through the second escape holes and the first escape holes.

3. The traceable card holder according to claim 1, wherein the surface of the top cover which is close to the first lining plate is provided with first sliding slots, and the first sliding slots are communicated with the mounting holes, the surface of the first sliding slots which is away from the first lining plate is provided with second sliding slots, and the second sliding slots penetrate the top cover;

the fixture block comprises a substrate, a pushing block and a latching strip, and the substrate is slidably provided in the first sliding slots, one side of the substrate which is close to the mounting holes is provided with the latching strip, and the latching strip is inserted in the card slots, one side of the substrate which is away from the mounting holes is provided with the springs, and the springs abut against the top cover, the surface of the substrate which is away from the first lining plate is provided with the pushing block, and the pushing block is provided in the second sliding slots.

4. The traceable card holder according to claim 3, wherein one side of the substrate which is away from the mounting holes is provided with positioning holes, and one part of the springs is provided in the positioning holes.

5. The traceable card holder according to claim 1, wherein the surface of the first clamp plate which is away from the second clamp plate is provided with first receiving slots and second receiving slots, and the second receiving slots are communicated with the first receiving slots, the surface of the second clamp plate which is away from the first clamp plate is provided with third receiving slots and fourth receiving slots, and the fourth receiving slots are communicated with the third receiving slots, the first receiving slots are opposite to the third receiving slots, and the second receiving slots are opposite to the fourth receiving slots;

the elastic band comprises a circular main body portion and a strip-shaped connection portion, and two ends of the connection portion are respectively connected with the main body portion, the main body portion is externally sleeved on the first clamp plate and the second clamp plate, and one part of the main body portion is provided in the first receiving slots, one part is provided in the third receiving slots, and one part of the connection portion is provided in the second receiving slots, one part is provided in the fourth receiving slots.

6. The traceable card holder according to claim 1, wherein the bottom cover components comprise a second lining plate and a bottom cover, and the second lining plate is connected with the second clamp plate, the elastic clamp is connected with the second lining plate, and the bottom cover is connected with the second lining plate.

7. The traceable card holder according to claim 6, wherein the second clamp plate is provided with second screw holes, and the second lining plate is provided with third escape holes, the bottom cover is provided with fourth escape holes, and the second screws are connected with the threads of the second screw holes through the third escape holes and the fourth escape holes.

* * * * *